US007443358B2

(12) United States Patent
Gorrell et al.

(10) Patent No.: US 7,443,358 B2
(45) Date of Patent: Oct. 28, 2008

(54) INTEGRATED FILTER IN ANTENNA-BASED DETECTOR

(75) Inventors: Jonathan Gorrell, Gainesville, FL (US); Mark Davidson, Florahome, FL (US); Michael E. Maines, Gainesville, FL (US)

(73) Assignee: Virgin Island Microsystems, Inc., St. Thomas, VI (US)

( * ) Notice: Subject to any disclaimer, the term of this patent is extended or adjusted under 35 U.S.C. 154(b) by 0 days.

(21) Appl. No.: 11/417,129

(22) Filed: May 4, 2006

(65) Prior Publication Data

US 2007/0200784 A1 Aug. 30, 2007

Related U.S. Application Data

(60) Provisional application No. 60/777,120, filed on Feb. 28, 2006.

(51) Int. Cl.
*H01Q 1/52* (2006.01)

(52) U.S. Cl. ..... 343/841; 343/783; 333/202

(58) Field of Classification Search ..... 343/700 MS, 343/783, 841; 333/202
See application file for complete search history.

(56) References Cited

U.S. PATENT DOCUMENTS

| | | | |
|---|---|---|---|
| 1,948,384 | A | 2/1934 | Lawrence |
| 2,307,086 | A | 1/1943 | Varian et al. |
| 2,431,396 | A | 11/1947 | Hansell |
| 2,473,477 | A | 6/1949 | Smith |
| 2,634,372 | A | 4/1953 | Salisbury |
| 2,932,798 | A | 4/1960 | Kerst et al. |
| 3,571,642 | A | 3/1971 | Westcott |
| 3,761,828 | A | 9/1973 | Pollard et al. |
| 3,923,568 | A | 12/1975 | Bersin |
| 3,989,347 | A | 11/1976 | Eschler |
| 4,282,436 | A | 8/1981 | Kapetanakos |
| 4,482,779 | A | 11/1984 | Anderson |
| 4,727,550 | A | 2/1988 | Chang et al. |
| 4,740,973 | A | 4/1988 | Madey |
| 4,746,201 | A | 5/1988 | Gould |
| 4,829,527 | A | 5/1989 | Wortman et al. |
| 4,838,021 | A | 6/1989 | Beattie |

(Continued)

FOREIGN PATENT DOCUMENTS

EP 0237559 B1 12/1991

(Continued)

OTHER PUBLICATIONS

Lee Kwang-Cheol et al., "Deep X-Ray Mask with Integrated Actuator for 3D Microfabrication", Conference: Pacific Rim Workshop on Transducers and Micro/Nano Technologies, (Xiamen CHN), Jul. 22, 2002.

(Continued)

*Primary Examiner*—Tan Ho
(74) *Attorney, Agent, or Firm*—Davidson Berquist Jackson & Gowdey LLP

(57) ABSTRACT

An antenna system includes a dielectric structure formed on a substrate; an antenna, partially within the dielectric structure, and supported by the dielectric structure; a reflective surface formed on the substrate. A shield blocks radiation from a portion of the antenna and from at least some of the dielectric structure. The shield is supported by the dielectric structure.

18 Claims, 5 Drawing Sheets

U.S. PATENT DOCUMENTS 5,023,563 A 6/1991 Harvey et al.
5,157,000 A 10/1992 Elkind et al.
5,163,118 A 11/1992 Lorenzo et al.
5,185,073 A 2/1993 Bindra
5,199,918 A 4/1993 Kumar
5,262,656 A 11/1993 Blondeau et al.
5,263,043 A 11/1993 Walsh
5,268,693 A 12/1993 Walsh
5,268,788 A 12/1993 Fox et al.
5,302,240 A 4/1994 Hori et al.
5,354,709 A 10/1994 Lorenzo et al.
5,446,814 A 8/1995 Kuo et al.
5,608,263 A 3/1997 Drayton et al.
5,668,368 A 9/1997 Sakai et al.
5,705,443 A 1/1998 Stauf et al.
5,737,458 A 4/1998 Wojnarowski et al.
5,744,919 A 4/1998 Mishin et al.
5,757,009 A 5/1998 Walstrom
5,767,013 A 6/1998 Park
5,790,585 A 8/1998 Walsh
5,811,943 A 9/1998 Mishin et al.
5,821,836 A 10/1998 Katehi et al.
5,821,902 A * 10/1998 Keen ..... 343/700 MS
5,831,270 A 11/1998 Nakasuji
5,847,745 A 12/1998 Shimizu et al.
5,889,449 A 3/1999 Fiedziuszko
5,902,489 A 5/1999 Yasuda et al.
6,008,496 A 12/1999 Winefordner et al.
6,040,625 A 3/2000 Ip
6,060,833 A 5/2000 Velazco
6,080,529 A 6/2000 Ye et al.
6,195,199 B1 2/2001 Yamada
6,222,866 B1 4/2001 Seko
6,281,769 B1 8/2001 Fiedziuszko
6,297,511 B1 10/2001 Syllaios et al.
6,338,968 B1 1/2002 Hefti
6,370,306 B1 4/2002 Sato et al.
6,373,194 B1 4/2002 Small
6,376,258 B2 4/2002 Hefti
6,407,516 B1 6/2002 Victor
6,441,298 B1 8/2002 Thio
6,470,198 B1 * 10/2002 Kintaka et al. ..... 505/210
6,504,303 B2 1/2003 Small
6,545,425 B2 4/2003 Victor
6,577,040 B2 6/2003 Nguyen
6,603,915 B2 8/2003 Glebov et al.
6,624,916 B1 9/2003 Green et al.
6,636,653 B2 10/2003 Miracky et al.
6,642,907 B2 * 11/2003 Hamada et al. ..... 343/873
6,738,176 B2 5/2004 Rabinowitz et al.
6,741,781 B2 5/2004 Furuyama
6,782,205 B2 8/2004 Trisnadi et al.
6,791,438 B2 9/2004 Takahashi et al.
6,829,286 B1 12/2004 Guilfoyle et al.
6,834,152 B2 12/2004 Gunn et al.
6,870,438 B1 3/2005 Shino et al.
6,885,262 B2 4/2005 Nishimura et al.
6,909,092 B2 6/2005 Nagahama
6,909,104 B1 6/2005 Koops
6,943,650 B2 * 9/2005 Ramprasad et al. ..... 333/202
6,944,369 B2 9/2005 Deliwala
6,953,291 B2 10/2005 Liu
6,965,284 B2 * 11/2005 Maekawa et al. ..... 333/204
6,965,625 B2 11/2005 Mross et al.
6,995,406 B2 2/2006 Tojo et al.
7,010,183 B2 3/2006 Estes et al.
7,092,588 B2 8/2006 Kondo
7,092,603 B2 8/2006 Glebov et al.
7,122,978 B2 10/2006 Nakanishi et al.
7,177,515 B2 2/2007 Estes et al.
7,267,459 B2 9/2007 Matheson
7,267,461 B2 9/2007 Kan et al.
2001/0025925 A1 10/2001 Abe et al.
2002/0009723 A1 1/2002 Hefti
2002/0027481 A1 3/2002 Fiedziuszko
2002/0036264 A1 3/2002 Nakasuji et al.
2002/0053638 A1 5/2002 Winkler et al.
2002/0135665 A1 9/2002 Gardner
2003/0012925 A1 1/2003 Gorrell
2003/0016412 A1 1/2003 Small
2003/0016421 A1 1/2003 Small
2003/0034535 A1 2/2003 Barenburu et al.
2003/0155521 A1 8/2003 Feuerbaum
2003/0164947 A1 9/2003 Vaupel
2003/0179974 A1 9/2003 Estes et al.
2003/0206708 A1 11/2003 Estes et al.
2003/0214695 A1 11/2003 Abramson et al.
2004/0061053 A1 4/2004 Taniguchi et al.
2004/0108473 A1 6/2004 Melnychuk et al.
2004/0136715 A1 7/2004 Kondo
2004/0150991 A1 8/2004 Ouderkirk et al.
2004/0171272 A1 9/2004 Jin et al.
2004/0180244 A1 9/2004 Tour et al.
2004/0213375 A1 10/2004 Bjorkholm et al.
2004/0217297 A1 11/2004 Moses et al.
2004/0231996 A1 11/2004 Webb
2004/0240035 A1 12/2004 Zhilkov
2004/0264867 A1 12/2004 Kondo
2005/0023145 A1 2/2005 Cohen et al.
2005/0045821 A1 3/2005 Noji et al.
2005/0054151 A1 3/2005 Lowther et al.
2005/0067286 A1 3/2005 Ahn et al.
2005/0082469 A1 4/2005 Carlo
2005/0092929 A1 5/2005 Schneiker
2005/0105690 A1 5/2005 Pau et al.
2005/0145882 A1 7/2005 Taylor et al.
2005/0162104 A1 7/2005 Victor et al.
2005/0190637 A1 9/2005 Ichimura et al.
2005/0194258 A1 9/2005 Cohen et al.
2005/0201707 A1 9/2005 Glebov et al.
2005/0201717 A1 9/2005 Matsumura et al.
2005/0212503 A1 9/2005 Deibele
2005/0249451 A1 11/2005 Baehr-Jones et al.
2006/0007730 A1 1/2006 Nakamura et al.
2006/0018619 A1 * 1/2006 Helffrich et al. ..... 385/134
2006/0035173 A1 2/2006 Davidson et al.
2006/0045418 A1 3/2006 Cho et al.
2006/0060782 A1 3/2006 Khursheed
2006/0062258 A1 3/2006 Brau et al.
2006/0159131 A1 7/2006 Liu et al.
2006/0164496 A1 7/2006 Tokutake et al.
2006/0208667 A1 9/2006 Lys et al.
2006/0274922 A1 12/2006 Ragsdale
2007/0003781 A1 1/2007 de Rochemont
2007/0013765 A1 1/2007 Hudson et al.
2007/0075264 A1 4/2007 Gorrell et al.
2007/0086915 A1 4/2007 LeBoeuf et al.
2007/0116420 A1 5/2007 Estes et al.

FOREIGN PATENT DOCUMENTS

JP 2004-32323 A 1/2004
WO WO 87/01873 3/1987
WO WO 93/21663 A1 10/1993
WO WO 00/72413 11/2000
WO WO 02/25785 3/2002
WO WO 02/077607 10/2002
WO WO 2004/086560 10/2004
WO WO 2005/015143 A2 2/2005
WO WO 2006/042239 A2 4/2006

OTHER PUBLICATIONS

Markoff, John, "A Chip That Can Transfer Data Using Laser Light," The New York Times, Sep. 18, 2006.

S.M. Sze, "Semiconductor Devices Physics and Technology", 2nd Edition, Chapters 9 and 12, Copyright 1985, 2002.
Search Report and Written Opinion mailed Feb. 12, 2007 in PCT Appln. No. PCT/US2006/022682.
Search Report and Written Opinion mailed Feb. 20, 2007 in PCT Appln. No. PCT/US2006/022676.
Search Report and Written Opinion mailed Feb. 20, 2007 in PCT Appln. No. PCT/US2006/022772.
Search Report and Written Opinion mailed Feb. 20, 2007 in PCT Appln. No. PCT/US2006/022780.
Search Report and Written Opinion mailed Feb. 21, 2007 in PCT Appln. No. PCT/US2006/022684.
Search Report and Written Opinion mailed Jan. 17, 2007 in PCT Appln. No. PCT/US2006/022777.
Search Report and Written Opinion mailed Jan. 23, 2007 in PCT Appln. No. PCT/US2006/022781.
Search Report and Written Opinion mailed Mar. 7, 2007 in PCT Appln. No. PCT/US2006/022775.
Speller et al., "A Low-Noise MEMS Accelerometer for Unattended Ground Sensor Applications", Applied MEMS Inc., 12200 Parc Crest, Stafford, TX, USA 77477.
Thurn-Albrecht et al., "Ultrahigh-Density Nanowire Arrays Grown in Self-Assembled Diblock Copolymer Templates", Science 290. 5499, Dec. 15, 2000, pp. 2126-2129.
Search Report and Written Opinion mailed Aug. 24, 2007 in PCT Appln. No. PCT/US2006/022768.
Search Report and Written Opinion mailed Aug. 31, 2007 in PCT Appln. No. PCT/US2006/022680.
Search Report and Written Opinion mailed Jul. 16, 2007 in PCT Appln. No. PCT/US2006/022774.
Search Report and Written Opinion mailed Jul. 20, 2007 in PCT Appln. No. PCT/US2006/024216.
Search Report and Written Opinion mailed Jul. 26, 2007 in PCT Appln. No. PCT/US2006/022776.
Search Report and Written Opinion mailed Jun. 20, 2007 in PCT Appln. No. PCT/US2006/022779.
Search Report and Written Opinion mailed Sep. 12, 2007 in PCT Appln. No. PCT/US2006/022767.
Search Report and Written Opinion mailed Sep. 13, 2007 in PCT Appln. No. PCT/US2006/024217.
Search Report and Written Opinion mailed Sep. 17, 2007 in PCT Appln. No. PCT/US2006/022787.
Search Report and Written Opinion mailed Sep. 5, 2007 in PCT Appln. No. PCT/US2006/027428.
Search Report and Written Opinion mailed Sep. 17, 2007 in PCT Appln. No. PCT/US2006/022689.
International Search Report and Written Opinion mailed Nov. 23, 2007 in International Application No. PCT/US2006/022786.
Search Report and Written Opinion mailed Oct. 25, 2007 in PCT Appln. No. PCT/US2006/022687.
Search Report and Written Opinion mailed Oct. 26, 2007 in PCT Appln. No. PCT/US2006/022675.
Search Report and Written Opinion mailed Sep. 21, 2007 in PCT Appln. No. PCT/US2006/022688.
Search Report and Written Opinion mailed Sep. 25, 2007 in PCT appln. No. PCT/US2006/022681.
Search Report and Written Opinion mailed Sep. 26, 2007 in PCT Appln. No. PCT/US2006/024218.
J. C. Palais, "Fiber optic communications," Prentice Hall, New Jersey, 1998, pp. 156-158.
Search Report and Written Opinion mailed Dec. 20, 2007 in PCT Appln. No. PCT/US2006/022771.
Search Report and Written Opinion mailed Jan. 31, 2008 in PCT Appln. No. PCT/US2006/027427.
Search Report and Written Opinion mailed Jan. 8, 2008 in PCT Appln. No. PCT/US2006/028741.
Search Report and Written Opinion mailed Mar. 11, 2008 in PCT Appln. No. PCT/US2006/022679.
"Array of Nanoklystrons for Frequency Agility or Redundancy," NASA's Jet Propulsion Laboratory, NASA Tech Briefs, NPO-21033. 2001.
"Hardware Development Programs," Calabazas Creek Research, Inc. found at http://calcreek.com/hardware.html, date is not available.
"Antenna Arrays." May 18, 2002. www.tpub.com/content/neets/14183/css/14183_159.htm.
"Diffraction Grating," hyperphysics.phyastr.gsu.edu/hbase/phyopt/grating.html, date is not available.
Alford, T.L. et al., "Advanced silver-based metallization patterning for ULSI applications," Microelectronic Engineering 55, 2001, pp. 383-388, Elsevier Science B.V.
Amato, Ivan, "An Everyman's Free-Electron Laser?" Science, New Series, Oct. 16, 1992, p. 401, vol. 258 No. 5081, American Association for the Advancement of Science.
Andrews, H.L. et al., "Dispersion and Attenuation in a Smith-Purcell Free Electron Laser," The American Physical Society, Physical Review Special Topics—Accerlerators and Beams 8 (2005), pp. 050703-1-050703-9.
Backe, H. et al. "Investigation of Far-Infrared Smith-Purcell Radiation at the 3.41 MeV Electron Injector Linac of the Mainz Microtron MAMI," Institut fur Kernphysik, Universitat Mainz, D-55099, Mainz Germany, date is not available.
Bakhtyari, A. et al., "Horn Resonator Boosts Miniature Free-Electron Laser Power," Applied Physics Letters, May 12, 2003, pp. 3150-3152, vol. 82, No. 19, American Institute of Physics.
Bakhtyari, Dr. Arash, "Gain Mechanism in a Smith-Purcell MicroFEL," Abstract, Department of Physics and Astronomy, Dartmouth College, date is not available.
Bhattacharjee, Sudeep et al., "Folded Waveguide Traveling-Wave Tube Sources for Terahertz Radiation." IEEE Transactions on Plasma Science, vol. 32. No. 3, Jun. 2004, pp. 1002-1014.
Booske, J.H. et al., "Microfabricated TWTs as High Power, Wideband Sources of THz Radiation", date is not available.
Brau, C.A. et al., "Gain and Coherent Radiation from a Smith-Purcell Free Electron Laser," Proceedings of the 2004 FEL Conference, pp. 278-281.
Brownell, J.H. et al., "Improved μFEL Performance with Novel Resonator," Jan. 7, 2005, from website: www.frascati.enea.it/thz-bridge/workshop/presentations/Wednesday/We-07-Brownell.ppt.
Brownell, J.H. et al., "The Angular Distribution of the Power Produced by Smith-Purcell Radiation," J. Phys. D: Appl. Phys. 1997, pp. 2478-2481, vol. 30, IOP Publishing Ltd., United Kingdom.
Chuang, S.L. et al., "Enhancement of Smith-Purcell Radiation from a Grating with Surface-Plasmon Excitation," Journal of the Optical Society of America, Jun. 1984, pp. 672-676, vol. 1 No. 6, Optical Society of America.
Chuang, S.L. et al., "Smith-Purcell Radiation from a Charge Moving Above a Penetrable Grating," IEEE MTT-S Digest, 1983, pp. 405-406, IEEE.
Far-IR, Sub-MM & MM Detector Technology Workshop list of manuscripts, session 6 2002.
Feltz, W.F. et al., "Near-Continuous Profiling of Temperature, Moisture, and Atmospheric Stability Using the Atmospheric Emitted Radiance Interferometer (AERI)," Journal of Applied Meteorology, May 2003, vol. 42 No. 5, H.W. Wilson Company, pp. 584-597.
Freund, H.P. et al., "Linearized Field Theory of a Smith-Purcell Traveling Wave Tube," IEEE Transactions on Plasma Science, Jun. 2004, pp. 1015-1027, vol. 32 No. 3, IEEE.
Gallerano, G.P. et al., "Overview of Terahertz Radiation Sources," Proceedings of the 2004 FEL Conference, pp. 216-221.
Goldstein, M. et al., "Demonstration of a Micro Far-Infrared Smith-Purcell Emitter," Applied Physics Letters, Jul. 28, 1997, pp. 452-454, vol. 71 No. 4, American Institute of Physics.
Gover, A. et al., "Angular Radiation Pattern of Smith-Purcell Radiation," Journal of the Optical Society of America, Oct. 1984, pp. 723-728, vol. 1 No. 5, Optical Society of America.
Grishin, Yu. A. et al., "Pulsed Orotron—A New Microwave Source for Submillimeter Pulse High-Field Electron Paramagnetic Resonance Spectroscopy," Review of Scientific Instruments, Sep. 2004, pp. 2926-2936, vol. 75 No. 9, American Institute of Physics.
Ishizuka, H. et al., "Smith-Purcell Experiment Utilizing a Field-Emitter Array Cathode: Measurements of Radiation," Nuclear Instruments and Methods in Physics Research, 2001, pp. 593-598, A 475, Elsevier Science B.V.
Ishizuka, H. et al., "Smith-Purcell Radiation Experiment Using a Field-Emission Array Cathode," Nuclear Instruments and Methods in Physics Research, 2000, pp. 276-280, A 445, Elsevier Science B.V.

Ives, Lawrence et al., "Development of Backward Wave Oscillators for Terahertz Applications," Terahertz for Military and Security Applications, Proceedings of SPIE vol. 5070 (2003), pp. 71-82.
Ives, R. Lawrence, "IVEC Summary, Session 2, Sources I" 2002.
Jonietz, Erika, "Nano Antenna Gold nanospheres show path to all-optical computing," Technology Review, Dec. 2005/Jan. 2006, p. 32.
Joo, Youngcheol et al., "Air Cooling of IC Chip with Novel Microchannels Monolithically Formed on Chip Front Surface," Cooling and Thermal Design of Electronic Systems (HTD-vol. 319 & EEP-vol. 15), International Mechanical Engineering Congress and Exposition, San Francisco, CA Nov. 1995 pp. 117-121.
Joo, Youngcheol et al., "Fabrication of Monolithic Microchannels for IC Chip Cooling," 1995, Mechanical, Aerospace and Nuclear Engineering Department, University of California at Los Angeles.
Jung, K.B. et al., "Patterning of Cu, Co, Fe, and Ag for magnetic nanostructures," J. Vac. Sci. Technol. A 15(3), May/Jun. 1997, pp. 1780-1784.
Kapp, Oscar H. et al., "Modification of a Scanning Electron Microscope to Produce Smith-Purcell Radiation," Review of Scientific Instruments, Nov. 2004, pp. 4732-4741, vol. 75 No. 11, American Institute of Physics.
Kiener, C. et al., "Investigation of the Mean Free Path of Hot Electrons in GaAs/AlGaAs Heterostructures," Semicond. Sci. Technol., 1994, pp. 193-197, vol. 9, IOP Publishing Ltd., United Kingdom.
Kim, Shang Hoon, "Quantum Mechanical Theory of Free-Electron Two-Quantum Stark Emission Driven by Transverse Motion," Journal of the Physical Society of Japan, Aug. 1993, vol. 62 No. 8, pp. 2528-2532.
Korbly, S.E. et al., "Progress on a Smith-Purcell Radiation Bunch Length Diagnostic," Plasma Science and Fusion Center, MIT, Cambridge, MA, date is not available.
Kormann, T. et al., "A Photoelectron Source for the Study of Smith-Purcell Radiation", date is not available.
Kube, G. et al., "Observation of Optical Smith-Purcell Radiation at an Electron Beam Energy of 855 MeV," Physical Review E, May 8, 2002, vol. 65, The American Physical Society, pp. 056501-1-056501-15.
Liu, Chuan Sheng, et al., "Stimulated Coherent Smith-Purcell Radiation from a Metallic Grating," IEEE Journal of Quantum Electronics, Oct. 1999, pp. 1386-1389, vol. 35, No. 10, IEEE.
Manohara, Harish et al., "Field Emission Testing of Carbon Nanotubes for THz Frequency Vacuum Microtube Sources." Abstract. Dec. 2003. from SPIEWeb.
Manohara, Harish M. et al., "Design and Fabrication of a THz Nanoklystron", date is not available.
Manohara, Harish M. et al., "Design and Fabrication of a THz Nanoklystron" (www.sofia.usra.edu/det_workshop/ posters/session 3/3-43manohara_poster.pdf), PowerPoint Presentation, date is not available.
McDaniel, James C. et al., "Smith-Purcell Radiation in the High Conductivity and Plasma Frequency Limits," Applied Optics, Nov. 15, 1999, pp. 4924-4929, vol. 28 No. 22, Optical Society of America.
Meyer, Stephan, "Far IR, Sub-MM & MM Detector Technology Workshop Summary," Oct. 2002. (may date the Manohara documents).
Mokhoff, Nicolas, "Optical-speed light detector promises fast space talk," EETimes Online, Mar. 20, 2006, from website: www.eetimes.com/show/Article/jhtml?articleID=183701047.
Nguyen, Phucanh et al., "Novel technique to pattern silver using CF4 and CF4/O2 glow discharges," J.Vac. Sci. Technol. B 19(1), Jan./Feb. 2001, American Vacuum Society, pp. 158-165.
Nguyen, Phucanh et al., "Reactive ion etch of patterned and blanket silver thin films in Cl2/O2 and O2 glow discharges," J. Vac. Sci, Technol. B. 17 (5), Sep./Oct. 1999, American Vacuum Society, pp. 2204-2209.
Ohtaka, Kazuo, "Smith-Purcell Radiation from Metallic and Dielectric Photonic Crystals," Center for Frontier Science, pp. 272-273, Chiba University, 1-33 Yayoi, Inage-ku, Chiba-shi, Japan, date is not available.
Photonics Research, "Surface-Plasmon-Enhanced Random Laser Demonstrated," Photonics Spectra, Feb. 2005, pp. 112-113.
Platt, C.L. et al., "A New Resonator Design for Smith-Purcell Free Electron Lasers," 6Q19, p. 296, date is not available.
Potylitsin, A.P., "Resonant Diffraction Radiation and Smith-Purcell Effect," (Abstract), arXiv: physics/9803043 v2 Apr. 13, 1998.
Potylitsyn, A.P., "Resonant Diffraction Radiation and Smith-Purcell Effect," Physics Letters A, Feb. 2, 1998, pp. 112-116, A 238, Elsevier Science B.V.
S. Hoogland et al., "A solution-processed 1.53 μm quantum dot laser with temperature-invariant emission wavelength," Optics Express, vol. 14, No. 8, Apr. 17, 2006, pp. 3273-3281.
Savilov, Andrey V., "Stimulated Wave Scattering in the Smith-Purcell FEL," IEEE Transactions on Plasma Science, Oct. 2001, pp. 820-823, vol. 29 No. 5, IEEE.
Schachter, Levi et al., "Smith-Purcell Oscillator in an Exponential Gain Regime," Journal of Applied Physics, Apr. 15, 1999, pp. 3267-3269, vol. 65 No. 8, American Institute of Physics.
Schachter, Levi, "Influence of the Guiding Magnetic Field on the Performance of a Smith-Purcell Amplifier Operating in the Weak Compton Regime," Journal of the Optical Society of America, May 1990, pp. 873-876, vol. 7, No. 5, Optical Society of America.
Schachter, Levi, "The Influence of the Guided Magnetic Field on the Performance of a Smith-Purcell Amplifier Operating in the Strong Compton Regime," Journal of Applied Physics, Apr. 15, 1990, pp. 3582-3592, vol. 67 No. 8, American Institute of Physics.
Shih, I. et al., "Experimental Investigations of Smith-Purcell Radiation," Journal of the Optical Society of America, Mar. 1990, pp. 351-356, vol. 7, No. 3, Optical Society of America.
Shih, I. et al., "Measurements of Smith-Purcell Radiation," Journal of the Optical Society of America, Mar. 1990, pp. 345-350, vol. 7 No. 3, Optical Society of America.
Swartz, J.C. et al., "THz-FIR Grating Coupled Radiation Source," Plasma Science, 1998. 1D02, p. 126.
Temkin, Richard, "Scanning with Ease Through the Far Infrared," Science, New Series, May 8, 1998, p. 854, vol. 280, No. 5365, American Association for the Advancement of Science.
Walsh, J.E., et al., 1999. From website: http://www.ieee.org/organizations/pubs/newsletters/leos/feb99/hot2.htm.
Wentworth, Stuart M. et al., "Far-Infrared Composite Microbolometers," IEEE MTT-S Digest, 1990, pp. 1309-1310.
Yamamoto, N. et al., "Photon Emission From Silver Particles Induced by a High-Energy Electron Beam," Physical Review B, Nov. 6, 2001, pp. 205419-1-205419-9, vol. 64, The American Physical Society.
Yokoo, K. et al., "Smith-Purcell Radiation at Optical Wavelength Using a Field-Emitter Array," Technical Digest of IVMC, 2003, pp. 77-78.
Zeng, Yuxiao et al., "Processing and encapsulation of silver patterns by using reactive ion etch and ammonia anneal," Materials Chemistry and Physics 66, 2000, pp. 77-82.

* cited by examiner

INTEGRATED FILTER IN ANTENNA-BASED DETECTOR

CROSS-REFERENCE TO RELATED APPLICATIONS

This application is related to and claims priority from the following U.S. patent application, the entire contents of which is incorporated herein by reference: U.S. Provisional Patent Application No. 60/777,120, titled "Systems and Methods of Utilizing Resonant Structures," filed Feb. 28, 2006.

The present invention is related to the following co-pending U.S. patent applications which are all commonly owned with the present application, the entire contents of each of which are incorporated herein by reference:

(1) U.S. patent application Ser. No. 11/238,991, entitled "Ultra-Small Resonating Charged Particle Beam Modulator," and filed Sep. 30, 2005;

(2) U.S. patent application Ser. No. 10/917,511, entitled "Patterning Thin Metal Film by Dry Reactive Ion Etching," filed on Aug. 13, 2004;

(3) U.S. application Ser. No. 11/203,407, entitled "Method Of Patterning Ultra-Small Structures," filed on Aug. 15, 2005;

(4) U.S. application Ser. No. 11/243,476, entitled "Structures And Methods For Coupling Energy From An Electromagnetic Wave," filed on Oct. 5, 2005;

(5) U.S. application Ser. No. 11/243,477, entitled "Electron beam induced resonance," filed on Oct. 5, 2005;

(6) U.S. application Ser. No. 11/325,432, entitled "Resonant Structure-Based Display," filed on Jan. 5, 2006;

(7) U.S. application Ser. No. 11/410,924, entitled "Selectable Frequency EMR Emitter," filed on Apr. 26, 2006; and (8) U.S. application Ser. No. 11/400,280, entitled "Resonant Detector For Optical Signals," filed on Apr. 10, 2006.

COPYRIGHT NOTICE

A portion of the disclosure of this patent document contains material which is subject to copyright or mask work protection. The copyright or mask work owner has no objection to the facsimile reproduction by anyone of the patent document or the patent disclosure, as it appears in the Patent and Trademark Office patent file or records, but otherwise reserves all copyright or mask work rights whatsoever.

FIELD OF THE DISCLOSURE

This relates to ultra-small devices, and, more particularly, to ultra-small antennas.

INTRODUCTION & BACKGROUND

Antennas are used for detecting electromagnetic radiation (EMR) of a particular frequency.

As is well known, frequency (f) of a wave has an inverse relationship to wavelength (generally denoted $\lambda$). The wavelength is equal to the speed of the wave type divided by the frequency of the wave. When dealing with electromagnetic radiation (EMR) in a vacuum, this speed is the speed of light c in a vacuum. The relationship between the wavelength $\lambda$ of an electromagnetic wave its frequency f is given by the equation:

$$f = \frac{c}{\lambda}$$

As shown in FIG. 1, a typical antenna 10 is formed to detect electromagnetic waves having a certain frequency f, with a corresponding wavelength ($\lambda_m$). This desired frequency may be referred to herein as the desired detection frequency. The antenna 10 is a so-called quarter wavelength antenna, and its length is a multiple (preferably an odd multiple) of a quarter of the desired detection wavelength, i.e., an odd multiple of ¼ $\lambda_m$.

Note that when a electromagnetic wave (W) with wavelength $\lambda_m$ is incident on the antenna 10, this causes a standing wave (denoted by the dashed line in the drawing) to be formed in the antenna. The standing wave is reflected of the end of the antenna, to form a second standing wave (denoted by the dotted line in the drawing). The wavelength of the standing wave is ½ $\lambda_m$.

When an electromagnetic wave travels through a dielectric, the velocity of the wave will be reduced and it will effectively behave as if it had a shorter wavelength. Generally, when an electromagnetic wave enters a medium, its wavelength is reduced (by a factor equal to the refractive index n of the medium) but the frequency of the wave is unchanged. The wavelength of the wave in the medium, $\lambda'$ is given by:

$$\lambda' = \frac{\lambda_0}{n}$$

where $\lambda_0$ is the vacuum wavelength of the wave. Note that the antenna 10 shown in FIG. 1 is formed of an homogenous material, typically a metal.

It is desirable to have more selectivity/sensitivity to specific frequencies in antenna detectors.

BRIEF DESCRIPTION OF THE DRAWINGS

The following description, given with respect to the attached drawings, may be better understood with reference to the non-limiting examples of the drawings, wherein.

THE PRESENTLY PREFERRED EXEMPLARY EMBODIMENTS

Figure 1:
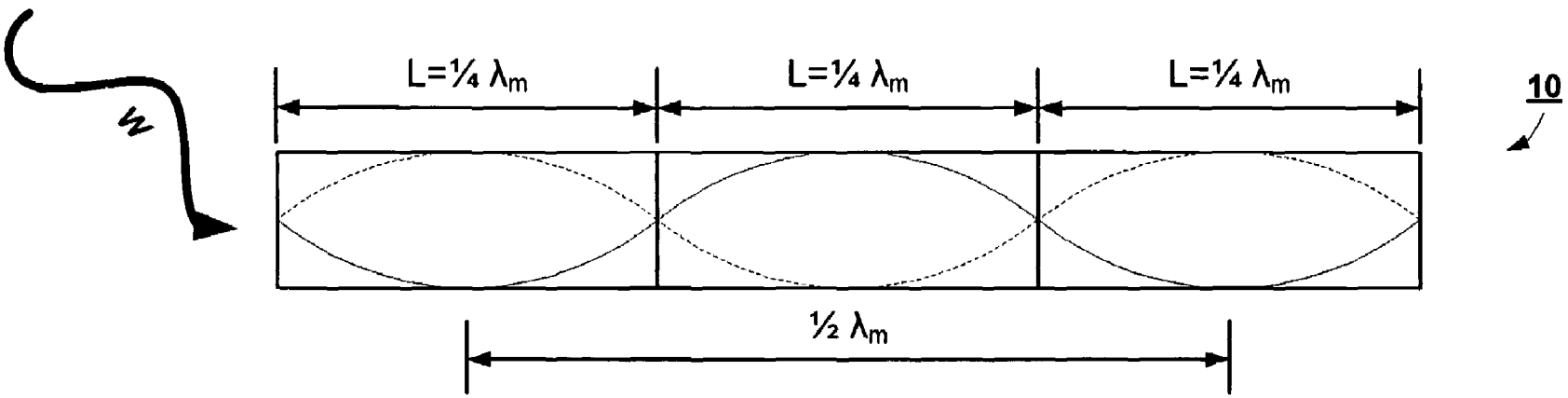
FIG. 1 shows various aspects of operation of an antenna.
Figure 2:
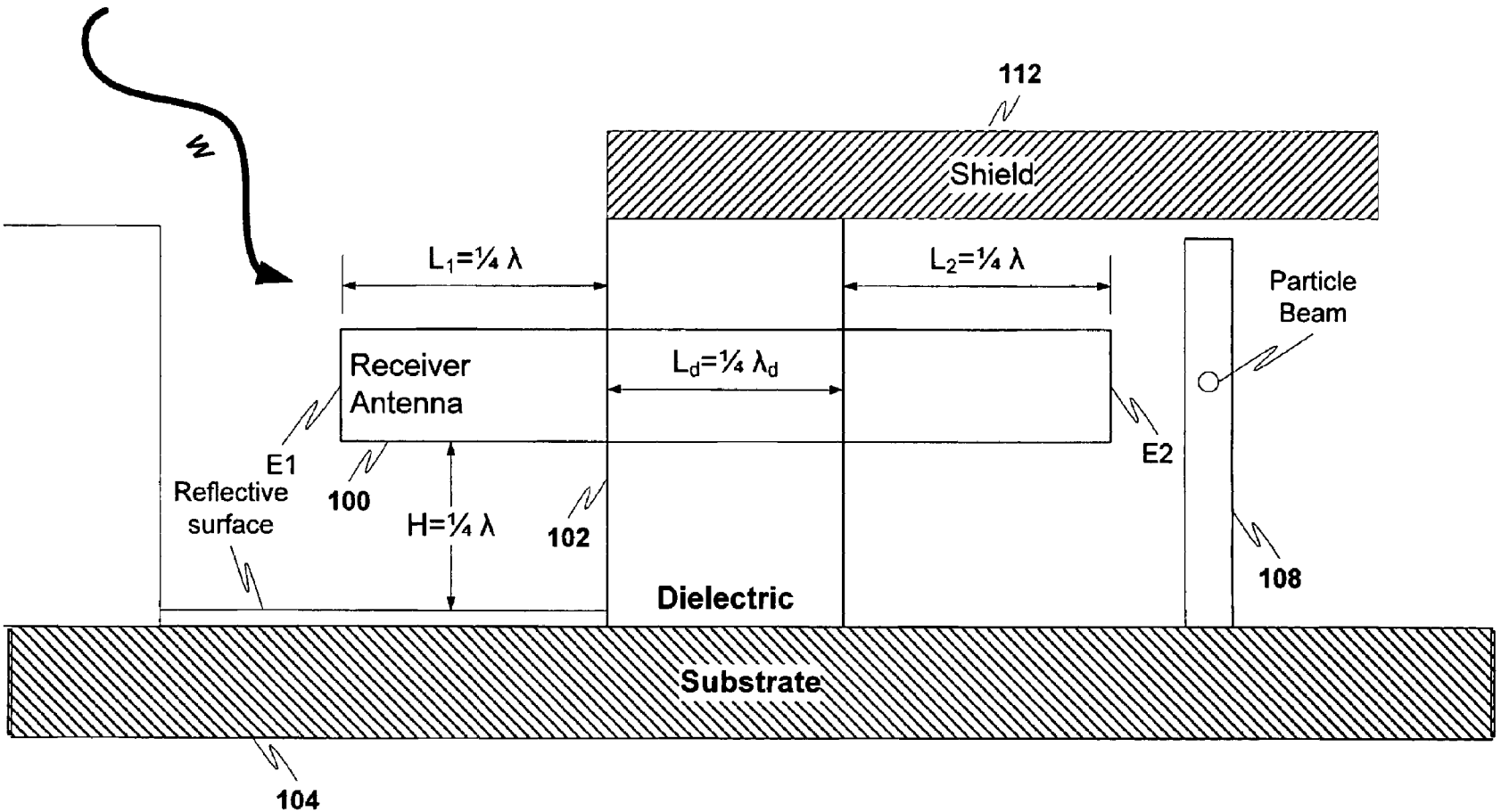
FIGS. 2-3 are side and top views, respectively, of an antenna with an integrated filter.
Figure 3:
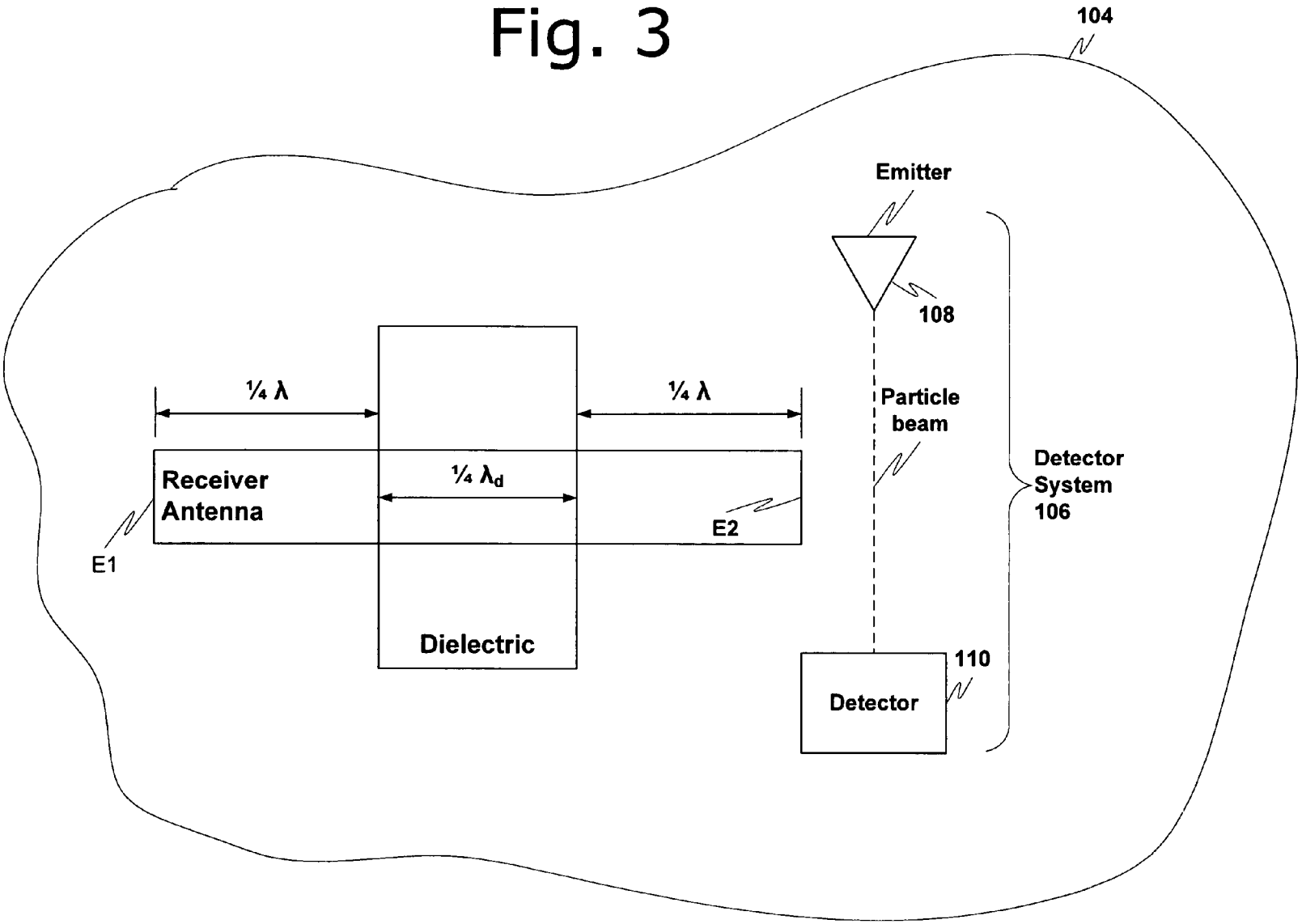

FIGS. 2-3 show a side view and a top view, respectively, of an antenna 100 formed within a dielectric structure 102. The dielectric 102 may be formed on a substrate 104. A detector system 106 is coupled with the antenna. The detector system may comprise an emitter 108 (a source of charged particles) and a detector 110 (not shown in FIG. 1) Various structures for the emitter/detector are disclosed in co-pending U.S. patent application Ser. No. 11/400,280, entitled "Resonant Detector For Optical Signals," and filed on Apr. 10, 2006, the entire contents of which have been incorporated herein by reference. The detector system may be formed on substrate 104 or elsewhere.

Preferably the detector system 106 is disposed at end E2 of the antenna system.

Although shown as rectangular, the end E2 of the antenna may be pointed to intensify the field.

A shield structure 112 (not shown in FIG. 2) is formed to block EMR from interacting with the detector system 106, in particular, with the particle beam emitted by the emitter 108. The shield 112 may be formed on a top surface of the dielectric structure.

An optional reflective surface 114 may be formed on the substrate 104 to reflect EMR to a receiving end E1 of the antenna 100.

The entire antenna structure, including the detection system, should preferably be provided within a vacuum.

For the purposes of this description, the antenna has three logical portions, namely a first antenna portion (shown in the drawing to the left of the dielectric structure 102), a second antenna portion within the dielectric structure, and a third antenna portion (shown in the drawing to the right of the dielectric structure).

The antenna 100 is formed to detect electromagnetic waves having a certain frequency f, with corresponding wavelength (λ). Accordingly, the length of the first antenna portion, $L_1$ and that of the third antenna portion $L_2$ are both ¼λ. The length $L_d$ of the second antenna portion, the portion within the dielectric, is $\frac{1}{4}\lambda_d$, where $\lambda_d$ is the wavelength of the signal within the dielectric 102. The antenna 100 is formed at a height H of ¼ λ above the substrate 104.

Figure 4:
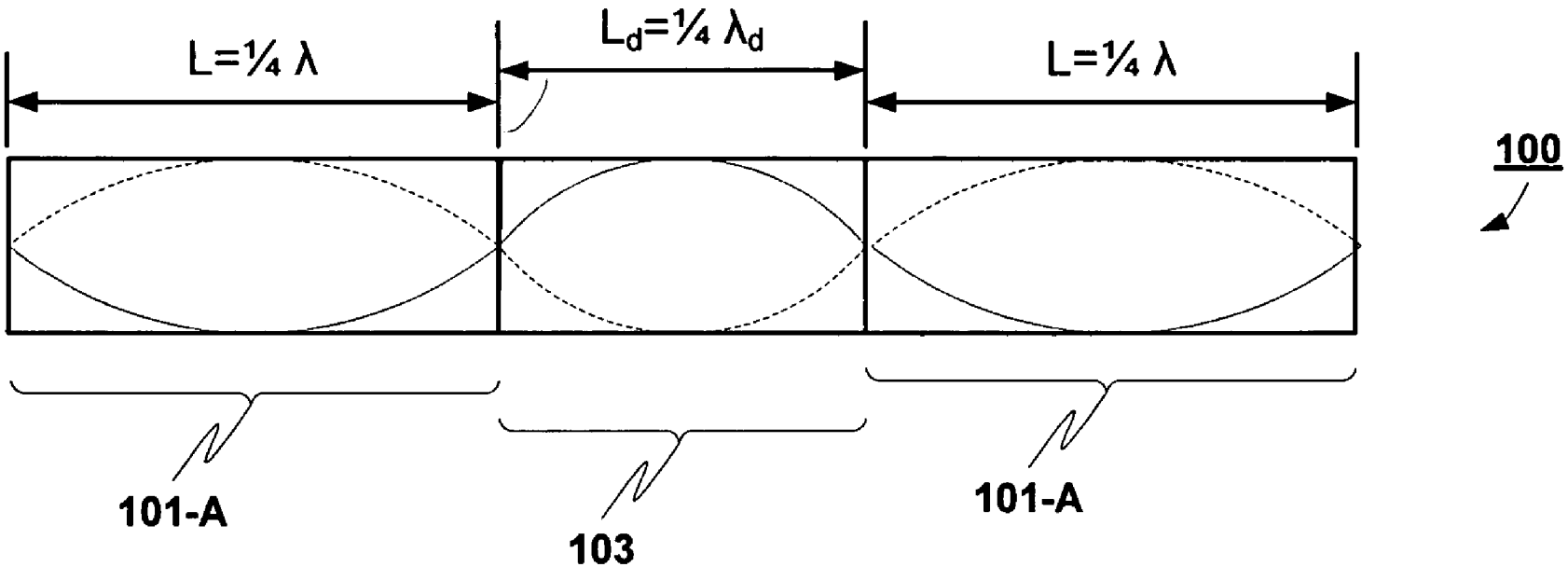
FIG. 4 shows various aspects of operation of an antenna.
Figure 5A:
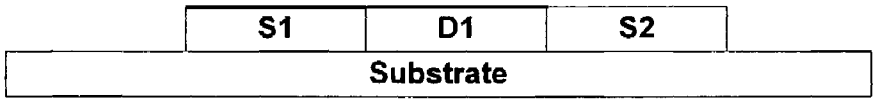
FIGS. 5(*a*)-5(*d*) show an exemplary process for making an antenna structure.
Figure 5B:
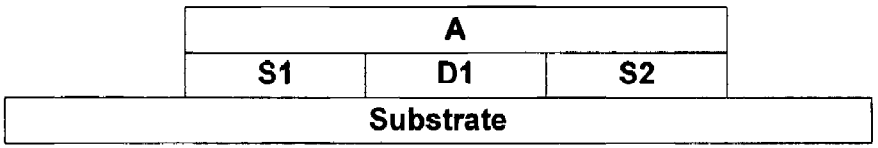
Figure 5C:
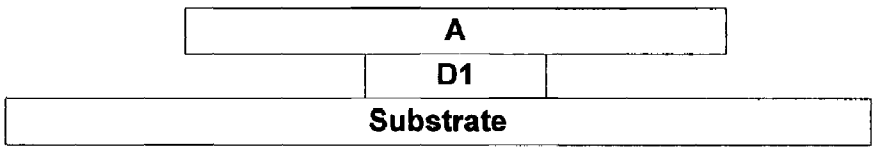
Figure 5D:
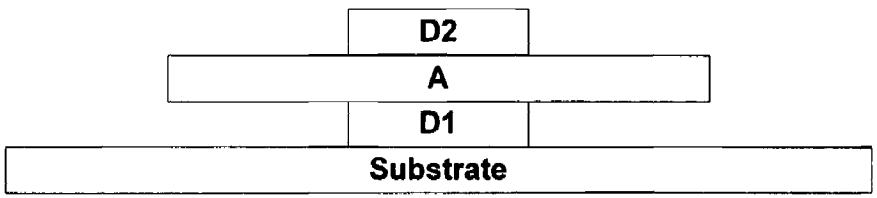

Recall that when an electromagnetic wave travels through a dielectric, its wavelength is reduced but the frequency of the wave is unchanged. The dielectric structure thus acts as a filter for a received signal, allowing EMR of the appropriate wavelength to pass therethrough. FIG. 4 shows the standing wave (s) formed in the antenna 100. As can be seen from the drawing, in the two metal segments 101-A, and 101-B, the wavelength of the standing wave is ¼λ, whereas in the dielectric segment 103, the wavelength of the standing wave is $\frac{1}{4}\lambda_d$—i.e., the wavelength corresponding to dielectric. The dimensions of the dielectric element can be determined, e.g., based on the relationship between the dielectric constants of the antenna material and the dielectric, e.g., using the following equation:

$$\frac{l_v}{l_d} = \sqrt{\frac{e_d(e_m + 1)}{e_m + e_d}}$$

where $l_v$ is the length of the metal portion (corresponding to $\lambda_v$, the wavelength of the wave in a vacuum), and $l_d$ is the length of the dielectric portion (corresponding to $\lambda_d$ is the wavelength of the wave in the dielectric material); $e_d$ is the dielectric constant of the dielectric material and $e_m$ is the dielectric constant of the metal. Those skilled in the art will understand that $l_v/l_d = \lambda_v/\lambda_d$).

From this equation, the value of $l_d$ can be determined as:

$$l_d = \frac{l_v\sqrt{e_d + e_m}}{\sqrt{e_d(e_m + 1)}}$$

The dielectric layer acts as a support for the antenna, and a filter.

The antenna structures may be formed of a metal such as silver (Ag).

With reference to FIGS. 5(*a*)-5(*d*), the antenna structures may be formed as follows (although other methods may be used):

First, the dielectric (D1) is formed on the substrate, along with two sacrificial portions (S1, S2) (FIG. 5(*a*)). The antenna (A) is then formed on the dielectric (D1) and the two sacrificial portions (S1, S2) (FIG. 5(*b*)). The sacrificial portions can then be removed (FIG. 5(*c*)), and then remainder of the dielectric (D2) can be formed on the antenna.

As shown in the drawings, the antenna comprises three portions, namely metal, dielectric, metal. Those skilled in the art will realize, upon reading this description, that the antenna may comprise three metal portions (e.g., in the order $metal_A$, $metal_B$, $metal_A$, where $metal_A$ and $metal_B$ different metals, e.g., silver and gold). Those skilled in the art will realize, upon reading this description, that the antenna may comprise three dielectric portions (e.g., in the order $D_a$, $D_b$, $D_a$, where $D_a$ and $D_b$ are different dielectric materials).

While certain configurations of structures have been illustrated for the purposes of presenting the basic structures of the present invention, one of ordinary skill in the art will appreciate that other variations are possible which would still fall within the scope of the appended claims. While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. An antenna system for detecting electromagnetic radiation, comprising:

a dielectric structure;

an antenna, partially within the dielectric structure, and supported by the dielectric structure, comprising:

a first metal portion having a length $l_v$;

a filter portion comprising a portion of the dielectric structure adjacent the first metal portion on a first side of the filter portion and having a length $l_d$ which is a function of both $l_v$ and the dielectric constant of the dielectric structure, and a second metal portion on a distal side of the filter portion; and a detection system disposed to detect electrical field changes in the antenna.

2. A system as in claim 1 wherein the dielectric structure is formed on a substrate, the system further comprising:

a reflective surface formed on the substrate.

3. A system as in claim 1 further comprising:

a shield blocking radiation from a portion of the antenna.

4. A system as in claim 3 wherein the shield also blocks radiation from the dielectric structure.

5. A system as in claim 3 wherein the shield is supported by the dielectric structure.

6. A system as in claim 1 wherein the length of the first metal portion is substantially equal to the length of the second metal portion.

7. A system as in claim 6 wherein the length of the dielectric portion of the antenna is based, at least in part, as a function of the dielectric constant of the dielectric material.

8. A system as in claim 1 wherein the detection system includes a source of charged particles.

9. A system as in claim 1 wherein the first metal portion and the second metal portions are comprised of the same metal.

10. A system as in claim 1 wherein the first metal portion and the second metal portions are comprised of different metals.

11. An antenna as in claim 1 wherein the length $l_d$ is substantially equal to $$l_d = \frac{l_v\sqrt{e_d + e_m}}{\sqrt{e_d(e_m + 1)}},$$

where $e_d$ is the dielectric constant of the dielectric structure and $e_m$ is the dielectric constant of at least one of the first and second metal portions.

12. An antenna system comprising:

a dielectric structure formed on a substrate;

an antenna, partially within the dielectric structure, and supported by the dielectric structure, comprising:

a first metal portion having a length $l_v$;

a filter portion comprising a portion of the dielectric structure adjacent the first metal portion on a first side of the filter portion and having a length $l_d$ which is a function of both $l_v$ and the dielectric constant of the dielectric structure, and a second metal portion on a distal side of the filter portion;

a reflective surface formed on the substrate;

a shield blocking radiation from a portion of the antenna and from at least some of the dielectric structure, the shield being supported by the dielectric structure; and a detection system disposed to detect electrical field changes in the antenna, wherein the detection system includes a source of charged particles.

13. An antenna comprising:

a dielectric filter portion;

a first metal portion on a first side of the dielectric filter portion; and a second metal portion on a distal side of the dielectric filter portion, wherein the first metal portion and the second metal portion are comprised of a different metal.

14. An antenna as in claim 13 wherein the antenna is constructed and adapted to detect electromagnetic waves having a particular frequency, and wherein a first length of the first metal portion and a second length of the second metal portion and a third length, of the dielectric filter portion, are each based, at least in part, on a function of the particular frequency.

15. An antenna as in claim 13 wherein the first length is substantially the same as the second length.

16. An antenna system comprising:

a first antenna portion comprising a first metal;

a second antenna portion on a first side of the first antenna portion, comprising a second metal different from the first metal;

a third antenna portion on a distal side of the first antenna portion, comprising of said second metal; and a shield blocking radiation from at least a part of the antenna; and a detection system disposed to detect electrical field changes in the antenna, wherein the detection system includes a source of charged particles.

17. An antenna system comprising:

a first antenna portion comprising a first dielectric material;

a second antenna portion on a first side of the first antenna portion comprising a second dielectric material; and a third antenna portion on a second side of the first antenna portion, comprising of said second dielectric material;

a shield blocking radiation from at least a part of the antenna; and a detection system disposed to detect electrical field changes in the antenna, wherein the detection system includes a source of charged particles.

18. An antenna system comprising:

a first antenna portion comprising a dielectric;

a second antenna portion on a first side of the first antenna portion comprising a metal; and a third antenna portion on a second side of the first antenna portion, comprising a metal;

a shield blocking radiation from at least a part of the antenna; and a detection system disposed to detect electrical field changes in the antenna, wherein the detection system includes a source of charged particles.

* * * * *